US012460410B2

(12) United States Patent
Zhou et al.

(10) Patent No.: US 12,460,410 B2
(45) Date of Patent: Nov. 4, 2025

(54) ROLLING INFLATABLE PARTITION WALL

(71) Applicant: A&C Future Inc., Newport Beach, CA (US)

(72) Inventors: Zhuangboyu Zhou, Santa Ana, CA (US); Sichen Li, Santa Ana, CA (US); Jiuqi Wang, Santa Ana, CA (US); Han Qin, Newport Beach, CA (US); Jiayang Qin, Newport Beach, CA (US); Xunming Jiang, Irvine, CA (US)

(73) Assignee: A&C FUTURE INC.

( * ) Notice: Subject to any disclaimer, the term of this patent is extended or adjusted under 35 U.S.C. 154(b) by 246 days.

(21) Appl. No.: 18/116,233

(22) Filed: Mar. 1, 2023

(65) Prior Publication Data

US 2024/0295119 A1 Sep. 5, 2024

(51) Int. Cl.

| | |
|---|---|
| ***E04B 1/343*** | (2006.01) |
| ***E04B 2/74*** | (2006.01) |
| ***E04H 4/08*** | (2006.01) |
| *B65H 75/36* | (2006.01) |
| *B65H 75/44* | (2006.01) |
| *E01F 13/02* | (2006.01) |
| *E04B 2/82* | (2006.01) |
| *E04H 4/10* | (2006.01) |

(52) U.S. Cl.

CPC ..... *E04B 2/7405* (2013.01); *E04B 1/343* (2013.01); *B65H 75/364* (2013.01); *B65H 75/4418* (2013.01); *E01F 13/022* (2013.01); *E01F 13/024* (2013.01); *E04B 2002/7479* (2013.01); *E04B 2/82* (2013.01); *E04H 4/08* (2013.01); *E04H 4/082* (2013.01); *E04H 4/103* (2013.01)

(58) Field of Classification Search

None

See application file for complete search history.

(56) References Cited

U.S. PATENT DOCUMENTS

| | | | | |
|---|---|---|---|---|
| 3,258,800 | A * | 7/1966 | Robinsky | E01D 15/20 244/905 |
| 3,298,142 | A * | 1/1967 | Isaac | E04H 15/20 138/119 |
| 3,574,979 | A * | 4/1971 | Chan | E04H 4/103 52/2.21 |
| 4,109,325 | A * | 8/1978 | Shuff | E04H 3/16 4/503 |
| 4,161,850 | A * | 7/1979 | Peterson | E04B 2/82 52/239 |
| 4,313,421 | A * | 2/1982 | Trihey | F24S 10/17 4/502 |

(Continued)

FOREIGN PATENT DOCUMENTS

WO WO-2005005883 A1 * 1/2005 ..... A47G 7/047

*Primary Examiner* — Phi D Tran

(74) *Attorney, Agent, or Firm* — Elizabeth Yang

(57) ABSTRACT

A kind of partition wall is introduced. The partition wall includes a housing, a roller wound with an inflatable wall body mounted inside the housing, and a shaft with a torsion spring mounted inside the roller. The inflatable wall body can be pulled out from the housing and can be rolled back to the housing by the torsion spring. The partition wall is rollable which offers people the chance to adjust their room space segmentation. It is also suitable for some small space such as a recreational vehicle or some mobile house. When people need to divide a bedroom from living room, they can expand out the partition wall.

15 Claims, 4 Drawing Sheets

(56) References Cited

U.S. PATENT DOCUMENTS 4,601,072 A * 7/1986 Aine ..... E04H 4/08 4/493
4,629,433 A * 12/1986 Magid ..... A47C 27/081 441/40
5,901,931 A * 5/1999 Mahoney ..... B62H 1/06 280/304
6,484,958 B1 * 11/2002 Xue ..... H02G 11/02 242/378.1
6,834,813 B1 * 12/2004 Nobi ..... B65H 75/4434 137/355.16
8,528,623 B2 * 9/2013 Roberts ..... E06B 9/54 160/267.1
8,550,574 B2 * 10/2013 Jensen ..... A47F 3/004 160/135
9,351,599 B2 * 5/2016 Roberts ..... E06B 9/54
9,907,438 B2 * 3/2018 Ross ..... A47K 3/302
10,047,558 B2 * 8/2018 Hummel ..... E06B 3/80
11,105,148 B2 * 8/2021 Shipman ..... E06B 9/42
11,131,090 B2 * 9/2021 Klein ..... B32B 27/12
12,054,937 B2 * 8/2024 Baum ..... E04B 1/34861
2002/0092628 A1 * 7/2002 Todd ..... E06B 9/13 160/309
2003/0192974 A1 * 10/2003 Hopper ..... B65H 75/4415 242/376
2008/0229689 A1 * 9/2008 Trionfetti ..... E04H 1/1272 160/122
2011/0114272 A1 * 5/2011 Roberts ..... E06B 9/54 160/293.1
2014/0041814 A1 * 2/2014 Roberts ..... E06B 9/54 160/271
2016/0265275 A1 * 9/2016 Rosell Rosell ..... E06B 9/78
2016/0326705 A1 * 11/2016 Torsiello ..... E01F 13/028
2017/0167093 A1 * 6/2017 Punzengruber ..... E01F 13/022
2019/0063018 A1 * 2/2019 Reiner ..... B65H 75/4471
2021/0247078 A1 * 8/2021 Nakagawa ..... F24F 11/56
2022/0166203 A1 * 5/2022 Theiß ..... B65H 75/4407

* cited by examiner

ROLLING INFLATABLE PARTITION WALL

FIELD OF THE INVENTION

This application relates to a partition wall, more particularly, to an adjustable partition wall. Such a partition wall can be used in temporary homes, RVs, mobile homes, and offices, among other scenarios. This partition wall has the features of portability, light weight, easy to adjust the length and good warmth performance.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Dividing the space is sometimes needed. For example, in offices, there is sometimes a need to enclose temporary separation areas or private spaces. In the home, it is sometimes necessary to adjust the layout of the room space. Recreational vehicles and mobile houses used in outdoor work or camping also have the need to separate space according to needs.

Often a partition wall is used to solve the problem. The partition wall is a non-load-bearing wall.

There are two main types of partition walls, fixed and movable. Fixed partition is made of heavy of brittle material and are not convenient to disassemble and carry. Commonly used movable partitions can slide or turn or fold.

Both types are not suitable for recreational vehicles and mobile houses because of their relatively large size.

In addition, in the outdoor use environment of recreational vehicles and mobile houses the partition walls preferably also have the effect of insulation.

SUMMARY

Illustrative embodiments of the disclosure are generally directed to a rolling inflatable wall and a method of using the rolling inflatable wall.

In one general aspect, a rolling inflatable wall may include a housing with an opening; and a roller wound with an inflatable wall body may be mounted inside the housing, the inflatable wall body may have a pulling end. When the inflatable wall body is pulled out of the housing from the opening to a desired length with the pulling end, the pulled-out portion of the inflatable wall body may be inflated to form the pulled-out portion a partition wall.

In another aspect, a shaft with a torsion spring may be inside the roller, one end of the torsion spring may be fixed with the shaft, and another end of the torsion spring may be fixed with inner wall of the roller; the shaft may be fixed with the housing; the roller rotates around the shaft.

In another aspect, an air port may be provided on the inflatable wall body.

In another aspect, the pulling end may be mounted with a hook board, at least one hook may be provided on the hook board.

In another aspect, on the hook board, at least one hook is provided.

In another aspect, the opening may be equipped with a clip having an open state and a clamped state; in the open state, the inflatable wall body may be free to pass through the opening; and, in the clamped state, the inflatable wall body could not be pulled out further relative to the housing.

In another aspect, the housing at the opening may be a double-layered structure, in which the clip may be mounted.

In another aspect, the clip may be composed of two opposing sets of clip modules; each clip module may be equipped with a compression spring and a clamping plate; one end of the compression spring may rest against the inner wall of the housing at the opening, and another end may rest against the clamping plate; edges of clamping plates close to each other may be rounded.

In another aspect, the inflatable wall body may be made up of a plurality of identical inflatable wall blocks connected, air may be free to flow between interior of each inflatable wall block.

In another aspect, in inflation state, thickness of inflatable wall block edge joints may be less than thickness of center of the inflatable wall block.

In another aspect, the clip may clamp at the inflatable wall block edge joints.

In another aspect, a shaft with a torsion spring may be mounted inside the roller.

In another aspect, part of the inflatable wall body may form a door.

A method of using a rolling inflatable wall may comprise:

a. providing a rolling inflatable wall mentioned above;

b. pulling the inflatable wall body out of the housing with the pulling end to a desired length; and, c. inflating the inflatable wall body.

In another aspect, the opening may be equipped with a clip having an open state and a clamped state; in the open state, the inflatable wall body may be free to pass through the opening; in the clamped state, the inflatable wall body could not be pulled out further relative to the housing; when pulled-out inflatable wall body reaches the desired length, the clip may clamp the inflatable wall body; and, when continuing to pull the inflatable wall body out or rolling back the inflatable wall, the clip may be released to allow the inflatable wall body to pass.

In another aspect, when the inflatable wall body needs to be stored, the method may further comprise:

d. deflating the inflatable wall body; and, e. driving the roller, and the roller driving the inflatable wall body wound on it to rotate for storage.

Other embodiments of this aspect include corresponding apparatus, mechanisms, components, and elements.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings illustrate examples. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Figure 1A:
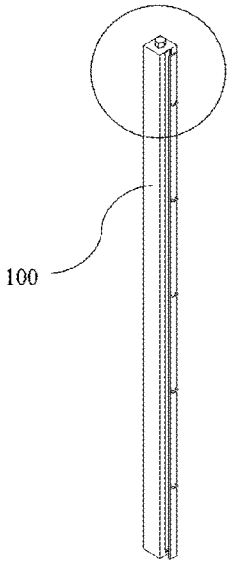
FIG. 1A illustrates the folded status of the rolling inflatable partition wall.
Figure 1B:
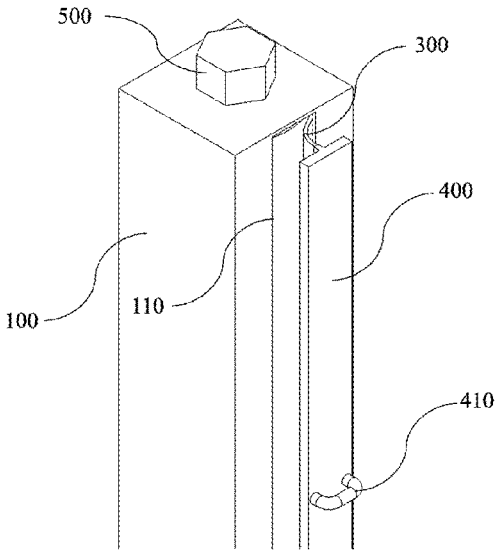
FIG. 1B illustrates an enlarged view of the rolling inflatable partition wall in FIG. 1A.
Figure 1C:
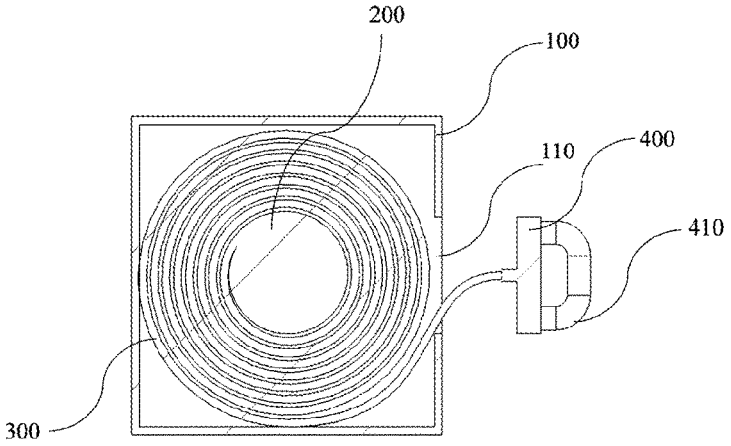
FIG. 1C is a cross-sectional view of the rolling inflatable partition wall in FIG. 1A.

FIG. 1A illustrates the folded status of the rolling inflatable partition wall. FIG. 1B illustrates an enlarged view of the rolling inflatable partition wall in FIG. 1A. FIG. 1C is a cross-sectional view of the rolling inflatable partition wall in FIG. 1A.

The embodiment provides a portable partition wall. This embodiment combines rolling door technology with inflatable wall.

More specifically, a rolling inflatable wall includes a housing 100 with an opening 110 and a roller 200 wound with an inflatable wall body 300 mounted inside the housing 100. The inflatable wall body 300 has a pulling end 310, when the inflatable wall body 300 is pulled out of the housing 100 from the opening 110 to a desired length with the pulling end 310, the pulled-out portion of the inflatable wall body 300 is inflated to form the pulled-out portion a partition wall.

Figure 1D:
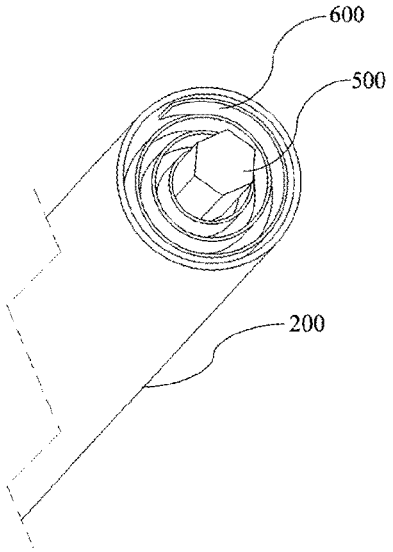
FIG. 1D illustrates the rolling inflatable partition wall with a torsion spring inside the roller.

When not inflated, since the inflatable wall body 300 is made of some soft plastic material or other good airtightness material, the inflatable wall body 300 will become a thin, soft sheet. Then it can be rolled back by the roller 200. The roller can be driven manually or by an automatic rolling-back mechanism In another embodiment, an automatic rolling-back mechanism is illustrated. FIG. 1D illustrates the rolling inflatable partition wall with a torsion spring inside the roller. A shaft 500 with a torsion spring 600 mounted inside the roller 200. One end of the torsion spring 600 is fixed with the roller 200, the other end of the torsion spring 600 is fixed with the inner wall of the roller 200. The shaft 500 is fixed with the housing 100 as shown in FIG. 1A. The roller 200 rotates around the shaft 500.

The torsion spring 600 should be in the opposite clockwise direction to the pull-out direction of the inflatable wall body 300. When the inflatable wall body 300 is pulled out, the torsion spring 600 turns and generates an opposing elastic force to the direction it is pulled out. This opposing elastic force enables the inflatable wall body 300 to roll back automatically when needed. The height of the housing 100 depends on the height of the inflatable wall body 300.

Figure 2:
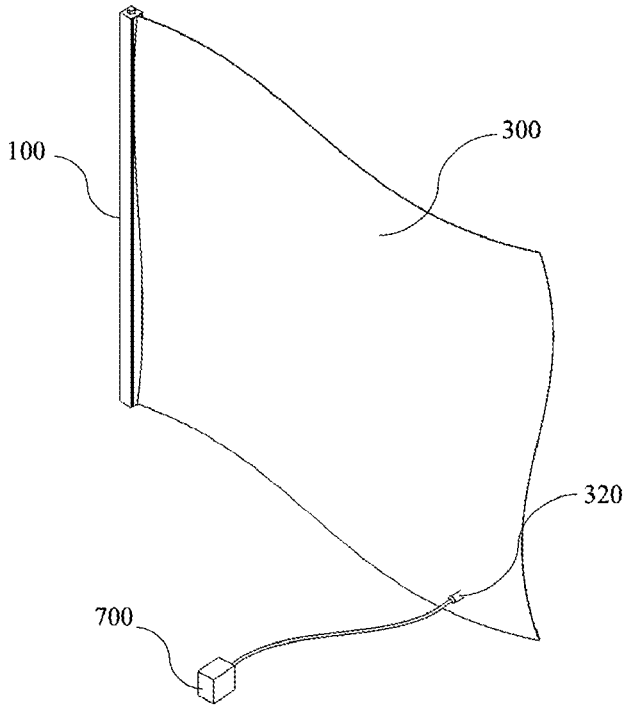
FIG. 2 illustrates the status when the rolling inflatable partition wall is pulled out.

FIG. 2 illustrates the status when the rolling inflatable partition wall is pulled out. When the rolling inflatable wall body 300 has been pulled out from the housing 100, it was thin and relatively soft.

In another embodiment, an air port 320 is provided on the inflatable wall body 300. When inflation is required, an air pump 700 can be attached to the inflatable wall body 300 via the air port 320. Then, the inflatable wall body 300 is able to become thicker by inflating.

Likewise, when deflation is required, an air pump 700 can be attached to the inflatable wall body 300 via the air port 320.

In another embodiment, the pulling end 310 is mounted with a connector. The connector can be any connector, as long as the connector can connect the pulling end 310 to a fixed structure that allows the partition wall to be fixed. Connectors are not limited to magnetic connections, hooks, and detachable connections such as bolts. In another embodiment, a hook board 400 is connected to the pulling 310. On the hook board 400, there is at least one hook 410. A plurality of hooks 410 evenly distributed along the length of the hook board 400 is preferred. After the housing 100 has been set to a specific area, users can pull the hook board 400, then pull the inflatable wall body 300 out from the housing 100. The hooks 410 can be used to attach to another fixed structure on the opposite side of the housing 100.

Figure 3:
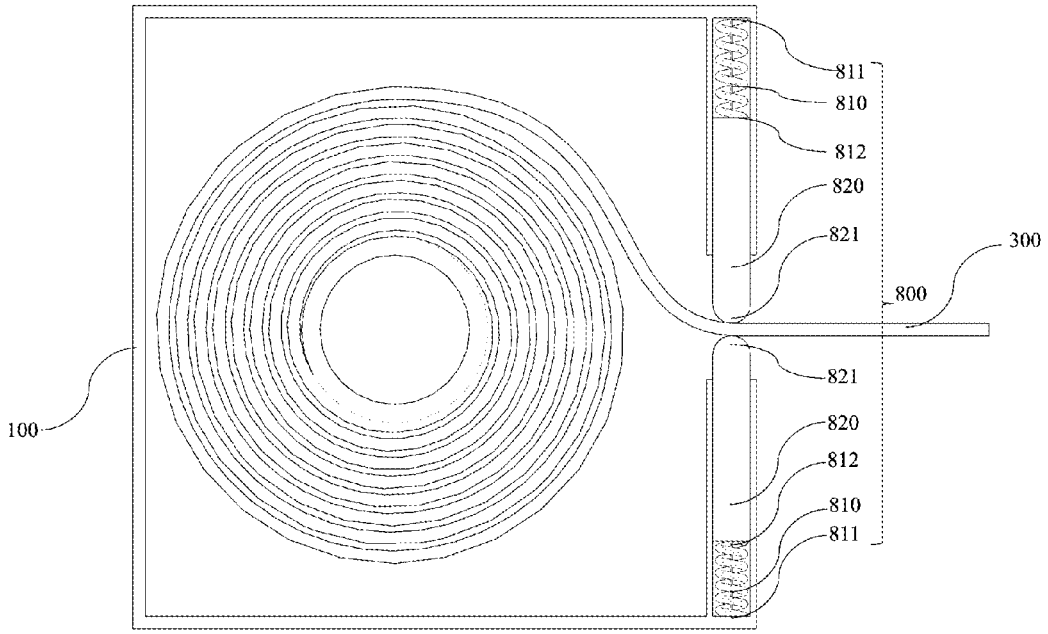
FIG. 3 illustrates the cross-sectional view of the rolling inflatable partition wall with a clip.

FIG. 3 illustrates the cross-sectional view of the rolling inflatable partition wall with a clip. It helps to adjust the length of inflatable wall body 300 by clamping it.

After the hooks have been attached to another fixed structure, a clip 800 will clamp the wall inflatable wall body 300 tightly along the opening 110 direction.

The opening 110 is equipped with a clip 800. The clip 800 has an open state and a clamped state; in the open state, the inflatable wall body 300 is free to pass through the opening 110; and, in the clamped state, the inflatable wall body 300 cannot be pulled out further relative to the housing 100. FIG. 3 shows a clamped state of the clip 800.

In another embodiment, the housing 100 at the opening is a double-layered structure, in which the clip 800 is mounted.

As shown in FIG. 3, in another embodiment, the clip 800 is composed of two opposing sets of clip modules; the clip modules have the same structures; each clip module is equipped with a compression spring 810 and a clamping plate 820; one end 811 of the compression spring 810 rests against inner wall of the housing 100 at the opening, and the other end 812 rests against the clamping plate 820; edges 821 of clamping plates 820 close to each other are rounded.

Figure 4A:
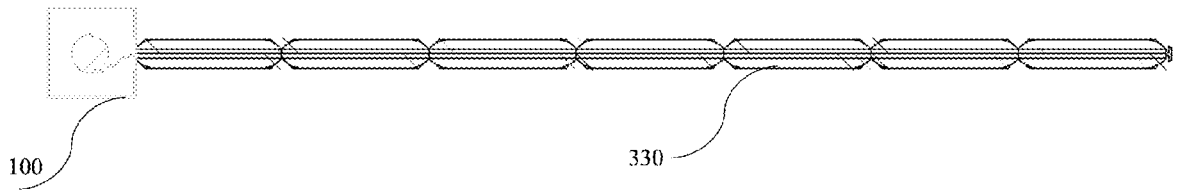
FIG. 4A illustrates a top view of the rolling inflatable partition wall.
Figure 4B:
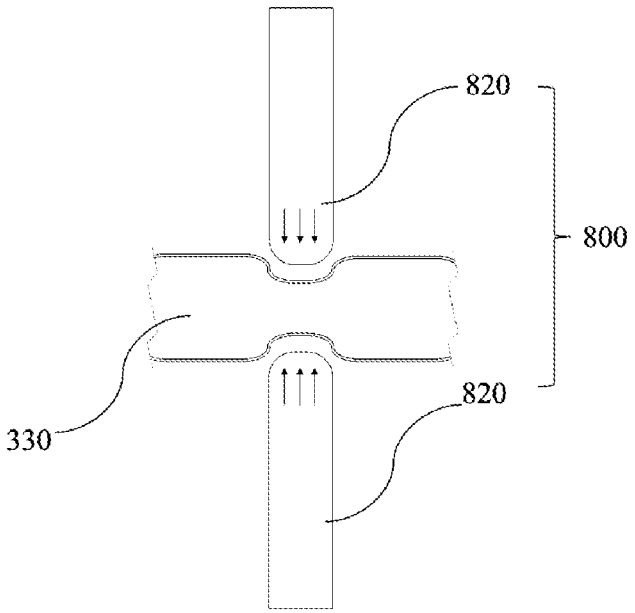
FIG. 4B illustrates the clip clamps at the inflatable wall block edge joints.
Figure 5:
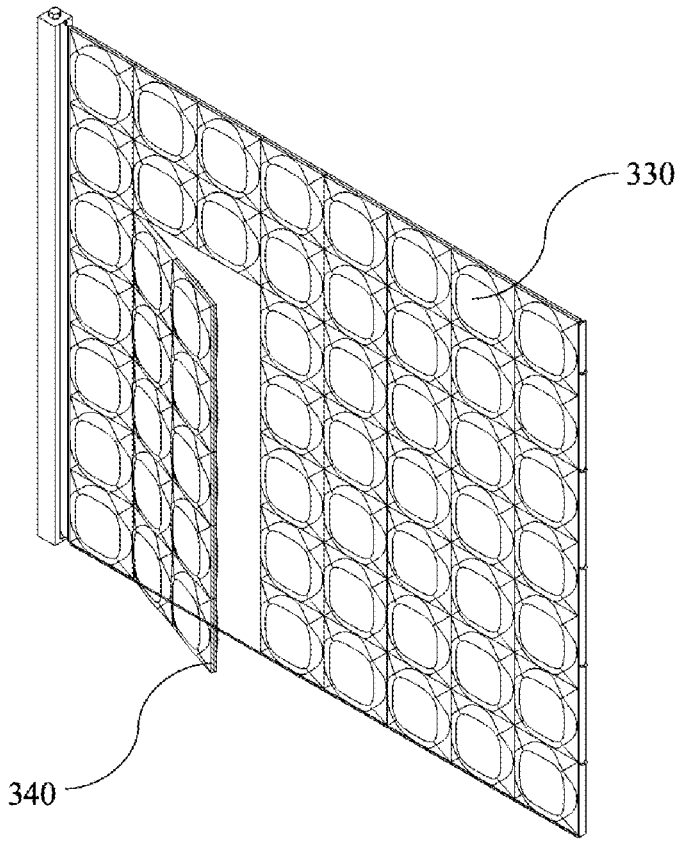
FIG. 5 illustrates the fully expanded state of the rolling inflatable partition wall with a door.

FIG. 4A illustrates a top view of the rolling inflatable partition wall after inflation; FIG. 4B illustrates the clip clamps at the inflatable wall block edge joints. FIG. 5 illustrates the fully expanded state of the rolling inflatable partition wall.

As the figures show, the inflatable wall body 300 is made up of a plurality of identical inflatable wall blocks 330 connected, and air is free to flow between the interior of each inflatable wall block 330.

FIG. 4A illustrates, after inflation, the thickness of inflatable wall block 330 edge joints is less than the thickness of the center of the inflatable wall block 330. Such a setup makes the inflatable wall body 300 more even in thickness after inflation and easier to maintain the designed shape.

FIG. 4B illustrates another advantage of the above setup. The clamping plates 820 of the clip 800 clamp at the edge joints of the inflatable wall block 330. In such a setup shortens the clamping distance of the clip 800 to the inflatable wall body 300 in the thickness direction, thus making the inflatable wall body 300 easier to clamp and obtaining a better airtightness.

FIG. 5 shows another embodiment. The inflatable wall body 300 is fixed by the housing 100 and the hook board 400 on the other side. Part of the inflatable wall body 300 forms a door 340. It makes it more convenient for users to pass through the inflatable wall body 300 without having to roll up the inflatable wall body 300.

The thickness of the inflatable wall body 300 in the inflated and deflated state can be determined by the size of the inflatable wall body and the use requirements. For example, the thickness can be 3 inches in the inflated state and 0.1 inch in the deflate state. The wall will become thicker and get a better soundproofing, heat insulation performance.

A method of using the rolling inflatable wall is also provided:

a. Providing a rolling inflatable wall 300 mentioned above;

b. pulling the inflatable wall body 300 out of the housing 100 with the pulling end 310 to a desired length;

c. inflating the inflatable wall body 300 after reaching the desired length.

When applying a hook board 400, hooks 410 can be used to attach to another fixed structure on the opposite side of the housing 100 in step (b).

When applying a clip 800 having an open state and a clamped state, in the open state, the inflatable wall body 300 is free to pass through the opening 110; in the clamped state, the inflatable wall body cannot be pulled out further relative to the housing 100. When pulled-out inflatable wall body 300 reaches the desired length, clamp the inflatable wall body 300 with the clip 800; and when continuing to pull the inflatable wall body 300 out or rolling back the inflatable wall 300, release the clip 800 to allow the inflatable wall body 300 to pass.

When the inflatable wall body 300 needs to be stored, further comprising the steps:

d. deflating the inflatable wall body 300; and, e. driving the roller 200, and the roller 300 driving the inflatable wall body 300 wound on it to rotate for storage.

When applying a shaft 500 with a torsion spring 600 mounted inside the roller 200, the torsion spring 600 can automatically drive the roll 200 to roll back in step (e).

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

Except as otherwise stated immediately above, nothing that has been stated or illustrated is intended or should be interpreted to cause a dedication of any component, step, feature, object, benefit, advantage, or equivalent to the public, regardless of whether it is recited in the claims.

The terms and expressions used herein have the ordinary meaning accorded to such terms and expressions in their respective areas, except where specific meanings have been set forth. Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by "a" or "an" does not, without further constraints, preclude the existence of additional elements of the identical type.

What is claimed is:

1. A rolling inflatable wall comprising:

a housing having an opening;

a roller wound with an inflatable wall body mounted inside the housing; and, wherein, the inflatable wall body has a pulling end, when the inflatable wall body is pulled out of the housing from the opening to a specified length with the pulling end, pulled-out portion of the inflatable wall body is inflated to form the pulled-out portion a partition wall, wherein the opening is equipped with a clip having an open state and a clamped state; in the open state, the inflatable wall body is free to pass through the opening; and, in the clamped state, the inflatable wall body cannot be pulled out further relative to the housing.

2. The rolling inflatable wall of claim 1, wherein a shaft with a torsion spring is inside the roller, one end of the torsion spring is fixed with the shaft, another end of the torsion spring is fixed with inner wall of the roller; the shaft is fixed with the housing; the roller rotates around the shaft.

3. The rolling inflatable wall of claim 1, wherein an air port is provided on the inflatable wall body.

4. The rolling inflatable wall of claim 1, wherein the pulling end is mounted with a hook board, at least one hook is provided on the hook board.

5. The rolling inflatable wall of claim 1, wherein the housing at the opening is a double-layered structure, in which the clip is mounted.

6. The rolling inflatable wall of claim 5, wherein the clip is composed of two opposing sets of clip modules; each clip module is equipped with a compression spring and a clamping plate; one end of the compression spring rests against inner wall of the housing at the opening, and another end rests against the clamping plate; edges of clamping plates close to each other are rounded.

7. The rolling inflatable wall of claim 6, wherein the inflatable wall body is made up of a plurality of identical inflatable wall blocks connected, air is free to flow between interior of each inflatable wall block.

8. The rolling inflatable wall of claim 7, wherein after inflation, thickness of inflatable wall block edge joints is less than thickness of center of inflatable wall block.

9. The rolling inflatable wall of claim 8, wherein the clip clamps at the inflatable wall block edge joints.

10. The rolling inflatable wall of claim 1, wherein the inflatable wall body is made up of a plurality of identical inflatable wall blocks connected, air is free to flow between interior of each inflatable wall block.

11. The rolling inflatable wall of claim 10, wherein in an inflation state, thickness of inflatable wall block edge joints is less than thickness of center of inflatable wall block.

12. The rolling inflatable wall of claim 1, wherein part of the inflatable wall body forms a door.

13. A method of using a rolling inflatable wall comprising:

a. providing a rolling inflatable wall of claim 1, b. pulling the inflatable wall body out of the housing with the pulling end to a desired length; and, c. inflating the inflatable wall body.

14. The method of claim 13, wherein, the opening is equipped with a clip having an open state and a clamped state; in the open state, the inflatable wall body is free to pass through the opening; in the clamped state, the inflatable wall body cannot be pulled out further relative to the housing;

when pulled-out inflatable wall body reaches the desired length, clamp the inflatable wall body with the clip; and, when continuing to pull the inflatable wall body out or rolling back the inflatable wall, release the clip to allow the inflatable wall body to pass.

15. The method of claim 13, wherein, when the inflatable wall body needs to be stored, further comprising:

d. deflating the inflatable wall body; and, e. driving the roller, and the roller driving the inflatable wall body wound on it to rotate for storage.

* * * * *